US010113737B2

(12) United States Patent
Sokolov

(10) Patent No.: US 10,113,737 B2
(45) Date of Patent: Oct. 30, 2018

(54) LED LUMINAIRE

(71) Applicant: SOCIETY WITH LIMITED LIABILITY "DIS PLUS", Moscow (RU)

(72) Inventor: Yuriy Borisovich Sokolov, Fryazino (RU)

(73) Assignee: Yuriy Borisovich Sokolov, Fryazino (RU)

( * ) Notice: Subject to any disclaimer, the term of this patent is extended or adjusted under 35 U.S.C. 154(b) by 253 days.

(21) Appl. No.: 15/117,418

(22) PCT Filed: Sep. 22, 2014

(86) PCT No.: PCT/RU2014/000702
§ 371 (c)(1),
(2) Date: Aug. 8, 2016

(87) PCT Pub. No.: WO2015/088386
PCT Pub. Date: Jun. 18, 2015

(65) Prior Publication Data

US 2018/0195708 A1 Jul. 12, 2018

(30) Foreign Application Priority Data

Jun. 26, 2014 (RU) ..... 2014125785

(51) Int. Cl.
*F21V 29/83* (2015.01)
*F21V 23/02* (2006.01)
(Continued)

(52) U.S. Cl.
CPC ..... *F21V 29/83* (2015.01); *F21V 3/00* (2013.01); *F21V 23/023* (2013.01); *F21V 29/15* (2015.01);
(Continued)

(58) Field of Classification Search
CPC ..... F21V 28/83; F21V 28/15; F21V 28/763; F21V 3/00; F21V 23/023; F21V 31/005; F21Y 2115/10; F21W 2131/103
See application file for complete search history.

(56) References Cited

U.S. PATENT DOCUMENTS

| | | | |
|---|---|---|---|
| 7,534,002 | B2 | 5/2009 | Yamaguchi et al. |
| 2012/0099317 | A1 | 4/2012 | Liu |

(Continued)

FOREIGN PATENT DOCUMENTS

| | | | |
|---|---|---|---|
| CN | 201014370 | Y | 1/2008 |
| CN | 203068326 | U | 7/2013 |
| GB | 2 348 272 | A | 9/2000 |
| JP | 2008-091185 | A | 4/2008 |

(Continued)

*Primary Examiner* — Mary Ellen Bowman
(74) *Attorney, Agent, or Firm* — Bryant J. Keller; Kirton McConkie

(57) ABSTRACT

The technical result of the invention is the creation of a moisture-proof LED luminaire, with improved cooling of optical assemblies with LEDs and of a power source as a result of the optical assemblies with LEDs being fastened to a body so as to be in thermal contact therewith, and the power source being fastened in the cavity of a cover so as to be in thermal contact with the cover. The body and the cover are interconnected so that air gaps are formed therein by end caps having through ventilation openings. The air gaps communicate with the cavity of the cover. The through ventilation openings communicate with the cavity of the body and the cavity of the cover and are designed to permit the passage of convection currents of air into the cavity of the body and the cavity of the cover, thus enabling more effective cooling of the body and the cover.

20 Claims, 3 Drawing Sheets

(51) Int. Cl.

| | |
|---|---|
| ***F21V 29/76*** | (2015.01) |
| ***F21V 3/00*** | (2015.01) |
| ***F21V 29/15*** | (2015.01) |
| ***F21V 31/00*** | (2006.01) |
| *F21Y 115/10* | (2016.01) |
| *F21W 131/103* | (2006.01) |

(52) U.S. Cl.
CPC ..... *F21V 29/763* (2015.01); *F21V 31/005* (2013.01); *F21W 2131/103* (2013.01); *F21Y 2115/10* (2016.08)

(56) References Cited

U.S. PATENT DOCUMENTS

| | | | | |
|---|---|---|---|---|
| 2013/0215606 | A1* | 8/2013 | Wang | F21S 8/086 362/190 |
| 2013/0271980 | A1* | 10/2013 | Quirion | F21V 31/00 362/235 |

FOREIGN PATENT DOCUMENTS

| | | | |
|---|---|---|---|
| RU | 112 340 | U1 | 1/2012 |
| RU | 118 398 | U1 | 7/2012 |
| RU | 128 696 | U1 | 5/2013 |
| RU | 147907 | | 11/2014 |
| RU | 2552100 | | 6/2015 |
| SU | 629403 | A1 | 10/1978 |
| SU | 1227910 | A1 | 4/1986 |
| TW | 201329388 | A | 7/2013 |
| WO | 88/02460 | A1 | 4/1988 |
| WO | 2013/063898 | A1 | 5/2013 |

* cited by examiner

LED LUMINAIRE

FIELD

The invention refers to the illuminating engineering sphere, notably to LED luminaires, and may be used as a source of light in the street (particularly, to be an illuminating element of a lamp pole) and inside a room.

BACKGROUND

Modern LED luminaires are effective sources of light, consume a little power and are characterized by long operating life. Usually, a high-capacity LED structure includes a radiator for abstraction of heat from the LEDs and power source. Quite often an LED luminaire case is used as this radiator, if it is produced of a heat-conducting material. And temperature inside the case is the same for LED and power source, which is often unacceptable, because LEDs may operate even at a 85-90 C case temperature, but for a power source this temperature can be destructive. Besides this, nowadays LEDs operating life may be more than 100 thousand hours, but power source operating life often doesn't exceed 30-40 thousand hours. This displays that for the period of 10-15 years it is necessary to renew the power source in a LED luminaire, set on a lamp pole or any other hard-to-reach external element, which is usually located on a big height, at least once. Replacement of the power source should be performed quickly and easily, without taking the LED luminaire from its location. Besides this, because street and tunnel LED luminaires operate in condition of low and high temperatures, and high humidity, it is necessary for them to be resistant to such external actions during 10-15 years of operation.

The device that may be the closest to the claimed invention is a LED luminaire, described in patent WO2013063898, which contains a case with optical members with LEDs, power source and end plugs, not having through ventilation openings, attached to it without expansion clearance. This LED luminaire is selected as the prototype of the claimed invention.

A disadvantage of the prototype LED luminaire is insufficient cooling of the case and optical members with LEDs and power source, attached to it, because optical members with LEDs and power source are installed without expansion clearance at the case, which is closed by end plugs, not having ventilation openings, and it doesn't let convection air flows pass through the inner hollow of the case and cool it. Besides this, the disadvantage of the prototype is complexity of power source replacement, because of absence of quick-detachable structure, where a power source may be attached to.

SUMMARY

The task of the claimed invention is creation of a damp-proof LED luminaire with improved cooling of optical members with LEDs and power source by attaching the optical members with LEDs, forming a thermal contact to the case, and the power source is attached, forming a thermal contact to the cover in its hollow, and the case and the cover are connected, forming air clearances between them through the heat insulating end plugs, having through ventilation openings, and air clearances connected with the hollow of the cover, and through ventilation openings connected with the hollow of the case and the hollow of the cover and produced with a possibility of letting in convection air flows to the hollow of the case and cover, providing more effective case and cover cooling, and a heat-reflecting screen, made of a heat insulating material, attached horizontally on side walls of the cover inside, and performed with a possibility of cover hollow heat insulation from the case, and the power source and optical members with LEDs are performed hermetic, and hermetically connected; and with more reliability and convenience for replacement power source location under the cover (the power source is attached to the cover from the inside in the cover hollow), which is connected with end plugs by detached connections, allowing one to quickly and easily detach the cover to replace the power source.

The problem is decided by creating a LED luminaire, containing a case, cover, end plugs power source, at least one fastening device and at least one optical member with LEDs, which is connected with the external surface of the bottom part of the case, forming a thermal contact and performed hermetic; and the case and the cover are made of heat conductive material and are connected via front and end plugs, made of heat resistant material and having through ventilation openings; hermetic power source electrically and hermetically connected with optical members with LEDs, and performed with a possibility of adaptation of the external power supply to the parameters of LEDs and attached to the cover from the inside in the cover hollow, forming a thermal contact; the fastening device is connected with the case and performed with a possibility of attaching a LED to the external element; the case is performed as a hollow section with open end parts; the cover is performed as a section, that has open end parts and open bottom part, lead in the direction of the top part of the case, and cover walls and the top part of the case form a through ventilation duct, performed with a possibility of letting in convection air flows, cooling the cover, power source and the top part of the case, and ventilation openings of the end plugs are connected with the hollow of the cover and performed with a possibility of letting in convection air flows into the cover hollow; and ventilation openings of the end plugs are also connected with the cover hollow and performed with a possibility of letting in convection air flows to the case hollow; and the cover is connected with end plugs on one side by two movable joints and by at least two detached connections on the other side, and the cover is performed with a possibility of opening to replace the power source by turning in the movable joints at disconnected detached connections; and a heat reflecting screen, made of heat isolator, is fixed at the side walls of the cover's inside, and performed with a possibility of heat reflection, that is produced by the case.

In the preferred variant of LED luminaire embodiment, the detached connection is performed as a thread connection, consisting of a threaded opening in the cover and a captive screw, bolted in the threaded opening in the cover and passing through the opening in the end plug; and movable joint is performed as an articulated joint, that consists of a threaded opening in the cover, through opening in the end plug and a captive screw, acting as a shaft, and inserted in a through opening in the end plug and bolted in the threaded opening in the cover.

In the preferred variant of LED luminaire embodiment, the case is connected with the end plugs by four threaded connections, each of them consists of threaded openings in the end part of the case, through openings in the end plugs and cutting screws, bolted in the threaded openings and passing through the through openings in the end plugs.

In the preferred variant of LED luminaire embodiment, the case has inner walls, which divide the case hollow into through ventilation ducts, having entrances and exits at the end parts of the case and performed with a possibility of letting in convection air flows, cooling the case.

In the preferred variant of LED luminaire embodiment, the case has two inner vertical walls, which divide the case hollow into three through ventilation ducts.

In the preferred variant of LED luminaire embodiment, the case and the cover are performed as aluminum structural extrusion.

In the preferred variant of LED luminaire embodiment, the cover section has a U-shape cross section, and case profile has a trapezium shape cross section.

In the preferred variant of LED luminaire embodiment, the external surface of the cover and inner surface of the case has cooling fins.

In the preferred variant of LED luminaire embodiment, the optical member with LEDs consists of a circuit board, on one side of which LEDs are located, and a lens plate, which covers the LEDs and hermetically connected with the circuit board, and the optical member with LEDs is connected with the external surface of the case bottom wall by connection, that consists of knobs, located on the external surface of the case bottom wall , and hitches, inserted into the knobs, and the hitches are performed as flexible elastic moldings.

In the preferred variant of LED luminaire embodiment, the lens plate is hermetically connected with the circuit board by silicon sealing agent. In the preferred variant of LED luminaire embodiment, the optical member with LEDs has a rectangular form, and is pressed by the hitches to the external surface of the case bottom wall along at least two sides.

In the preferred variant of LED luminaire embodiment, the fastening device contains a crosstop and a field tube, and the front end of the crosstop is connected with the case, and the rear end of the crosstop is connected with the field tube, which is performed with a possibility of connection with the external bearing element, and the place of connection of the crosstop and the field tube is covered by protective corrugated tube. In the preferred variant of LED luminaire embodiment, the front end of the crosstop is inserted into the opening in the rear end plugin the case central ventilation duct, and the rear end of the crosstop is inserted in the field tube.

In the preferred variant of LED luminaire embodiment, the field tube is performed with a possibility of connection with the external bearing element, selected from a number of bearing elements, containing a lamp pole bearing element, ceiling, walls.

In the preferred variant of LED luminaire embodiment, case side walls have external T-shape long slots. In the preferred variant of LED luminaire embodiment, the fastening device is a H-shape longitudinal connector, performed with a possibility of location of one of its parts in a T-shape long slot and fastening of its other part to the external element.

In the preferred variant of LED luminaire embodiment, the external element is a neighbor LED luminaire, which also has external T-shape long slots in side walls.

In the preferred variant of LED luminaire embodiment, it contains at least two additional cooling elements, having a T-shape cusp, located in a T-shape long slot of case side wall. In the preferred variant of LED luminaire embodiment, it contains a decorative side molding, located in a T-shape long slot of case side wall.

In the preferred variant of LED luminaire embodiment, it contains a decorative top molding, fixed longitudinally on the external surface of the cover top wall and covering the place of connection of the power source and the cover.

In the preferred variant of LED luminaire embodiment, the power source is electrically and hermetically connected with optical members with LEDs by electrical hermetic connection, including hermetic electrical wiring and wire-wire type hermetic electrical connectors.

DETAILED DESCRIPTION

1—case:
2—cover;
3—front end plug;
4—rear end plug;
5—power source;
6—circuit board;
7—lens plate;
8—space plate;
9—hitch;
10—decorative side molding;
11—decorative upper molding;
12—crosstop;
13—stiffening plate;
14—protective corrugated tube;
15—field tube;
16—cutting screw;
17—captive screw;
18—threaded rivet, countersunk;
19—screw;
20—threaded rivet;
21—bolt;
22—opening in the end plug;
23—heat reflecting screen;
24—air clearance:
25—inner wall;
26—cooling fin;
27—knob;
28—slot;
29—external surface of the case bottom wall;
30—case central ventilation duct;
31—threaded opening in the cover; and
32—threaded opening in the case.

Figure 1:
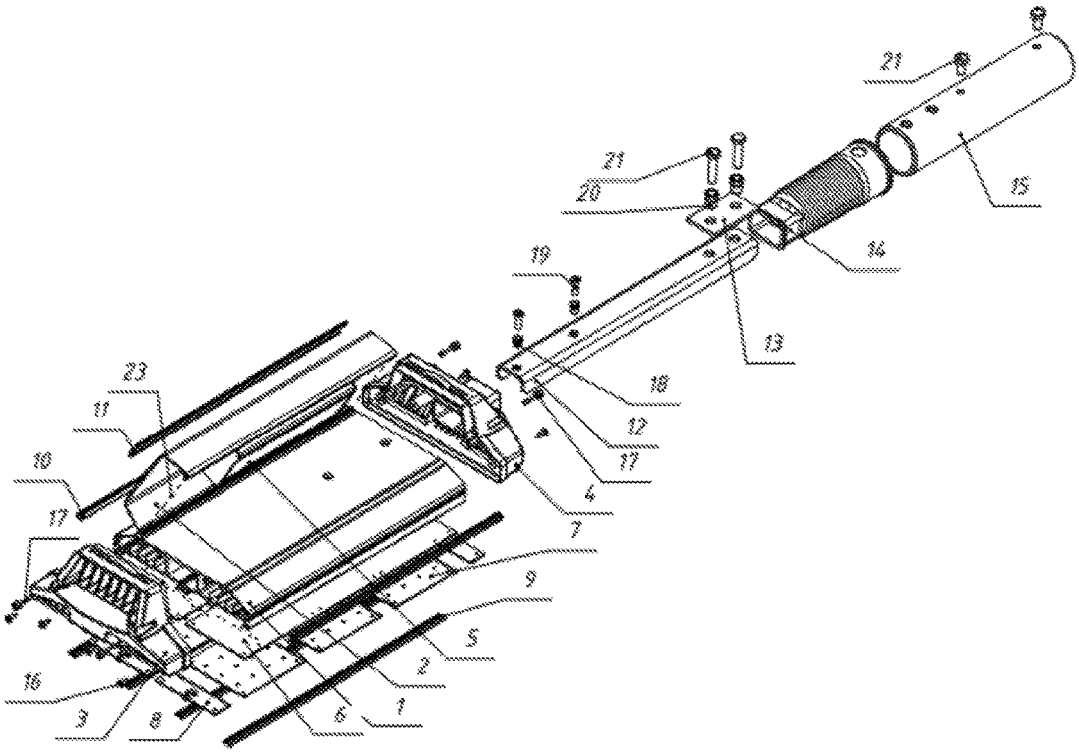
FIG. 1. Isometric view of LED embodiment variant, disassembled according to a representative embodiment of the invention.
Figure 2:
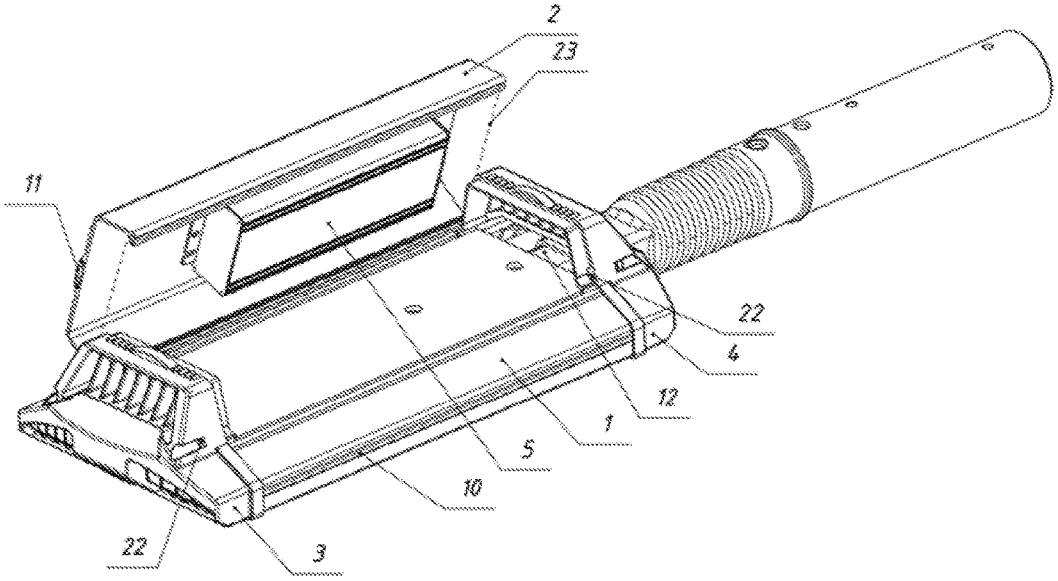
FIG. 2. Isometric view of LED embodiment variant, assembled according to a representative embodiment of the invention.
Figure 3:
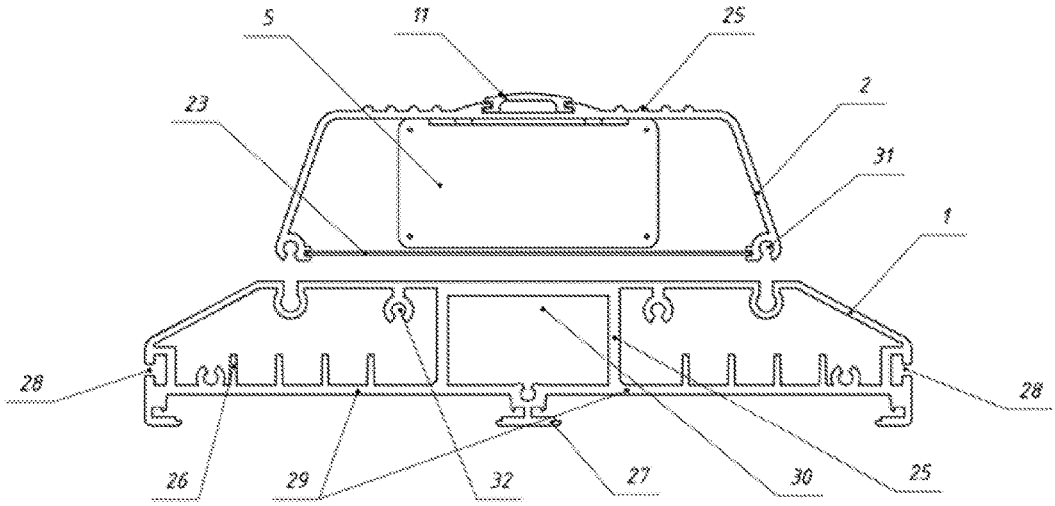
FIG. 3. Isometric view of LED embodiment variant, assembled, cross-section, according to a representative embodiment of the invention.

Let's examine the variant of embodiment of the claimed LED luminaire, shown in the FIGS. 1-3.

LED luminaire contains case 1 and cover 2, made of heat-conducting material and connected, forming air clearances 24 through the front and rear end plugs 3, 4, optical members with LEDs, consisting of circuit boards 6 with LEDs and lens plates 7, and hermetic power source 5, attached to the cover 2 from the inside in the cover 2 hollow, and a fastening device. End plugs 3, 4 are made of heat insulator, have through ventilation ducts and attached to the case 1 and cover 2 at the opposite end parts of the case 1 and cover 2. Fastening device consists of connection of crosstop 12 and field tube 15 and is performed with a possibility of fastening the LED luminaire to the external bearing element (for example, to the bearing tube of a lamp pole).

Case 1 is performed as a hollow section with open end parts. Cover 2 is performed as a section, which has open end parts and open bottom part, lead in the direction to the top part of the case 1. Air clearances 24 between the case 1 and cover 2 are performed with a possibility of letting in convection air flows in the cover 2 hollow. Cover 2 walls, and the upper cover 1 part form the through ventilation duct, performed with a possibility of letting in convection air flows, cooling the cover 2, power source 5 and the upper part of the case 1. End plugs 3, 4 ventilation openings are connected with the cover 2 hollow and are performed with a possibility of letting in convection air flows to the cover 2 hollow. End plugs 3,4 ventilation openings are also connected with the whole hollow of case 1 and are performed with a possibility of letting in convection air flows to the case 1 hollow. Optical members with LEDs are connected with the external surface 29 of the bottom part of the case 1, forming a thermal contact and consist of circuit boards 6, on one side of which LEDs are located, and lens plates 7, that are hermetically connected with circuit boards 6. Side walls of the cover 2 are connected with the end plugs 3, 4 by thread connections, each of which consists of threaded openings 31 in the end part of the cover 2 side wall and captive screws 17, bolted in the threaded openings 31 and passing through the openings 22 in the end plugs 3, 4. Two captive screws 17, bolted in at the opposite end sides in the common side wall of the cover 2, performed with a possibility of free rotation inside through openings 22 in the end plugs 3, 4. And the cover 2 is performed with a possibility of opening to replace the power source 5 by rotation in the articulated joint, formed by captive screws 17 and through openings 22 in the end plugs 3, 4, and bolted out other two captive screws 17.

Case 1 is connected with end plugs 3, 4 by four thread connections, each of which consists of threaded openings 32 in the end part of the case and cutting screws 16, bolted in the threaded openings 32 and passing through the openings in the end plugs 3, 4.

Case 1 has vertical inner walls 25, which divide the case 1 hollow into through ventilation ducts, having entrances and exits at the end parts of case 1 and performed with a possibility of letting in convection air flows, cooling case 1.

Case 1 and cover 2 may be performed as aluminum structural extrusion.

Cover 2 section has a U-shape cross-section.

Case 1 section has trapezoid cross-section.

External surface of cover 2 and inner surface of the case 1 has longitudinal cooling fins 26.

Lens plates 7, circuit boards 6 and external surface 29 of the case bottom wall are connected by the connection, which consists of knobs 27 on the external surface 29 of the case bottom wall and hitches 9, inserted in the knobs 27, and lens plates 7 and circuit boards 6 are pressed by hitches 9 to the external surface 29 of the case 1 bottom wall. Hitches 9 are performed as moldings.

Lens plates 7 are hermetically connected with the circuit boards 6 by silicon sealing agent.

Lens plates 7 and circuit boards 6 have a rectangular form, and lens plates 7 and circuit boards 6 are pressed by hitches 9 to the external surface of the case 1 bottom wall along two sides. At the sides of the lens plates to the circuit boards space plates 8 may be attached.

Inner vertical walls 25 divide the case 1 hollows into three through ventilation ducts.

Fastening device contains a crosstop 12 and a field tube 15. The front end of the crosstop 12 is connected with the case 1, and the rear end with the field tube 15, which is performed with a possibility of connection with external bearing element (for example, with a lamp pole). The place of connection of the crosstop 12 and field tube 15 is covered by protective corrugated tube 14.

The front end of the crosstop 12 is inserted into the opening in the rear end plug 4 and into the case 1 central ventilation duct and connected with the case 1 by a screw joint, consisting of threaded rivets for countersunk 18, fixed in the crosstop 12, and screws 19, bolted in the threaded rivets and passing through the openings in the case 1.

Rear end of the crosstop 12 is inserted into the field tube 15 and connected with it by a thread connection, consisting of threaded rivets 20, fixed in the crosstop 12, and bolts 21, screwed in the threaded rivetsи 20 and passing through the openings in the field tube 15 and stiffening plate 13, located above the crosstop 12.

Field tube 15 is performed with a possibility of connection with an external bearing element by a thread connection, consisting of through threaded openings in the field tube 15 and bolts 21, performed with a possibility of bolting in the threaded openings and fixation of external bearing element, inserted in the field tube 15.

LED luminaire contains upper molding 11, fixed longitudinally on the external surface of the cover 2 top wall.

Heat reflecting screen 23 is fixed on cover 2 side walls from the inside and is performed with a possibility of cover 2 hollow heat insulation from the side of case 1. LED luminaire contains a fastening device as T-shape long slots 28 in the case side walls 1, produced with a possibility of fixation a LED luminaire to the external bearing elements, with a possibility of fixating additional cooling elements, and with a possibility of connection LED luminaires between each other by H-shape longitudinal connector, performed with a possibility of insertion into T-shape long slots 28.

Decorative moldings 10 are inserted into the T-shape long slots 28.

Lamp pole fastening element, LED luminaire, ceiling, walls may serve as external bearing elements.

Power source 5 is attached to the cover 2 by threaded connection (not shown), each of which consists of threaded openings in the hermetic block and screws, bolted in the threaded openings and passing through the openings in the cover. The decorative upper molding 11 is fixed longitudinally on the external surface of the cover 2 top wall and covers the screw heads of the power source 5 and cover 2 connection. The power source 5 is electrically and hermetically connected with optical members with LEDs by hermetic electric connection (not shown), including hermetic electric wiring and wire-wire type hermetic electric connectors.

To improve cooling of the claimed LED luminaire, notably providing a possibility of the power source and LEDs operation in different independent temperatures in the structure of the claimed LED luminaire the case 1 section and cover 2 section are made of aluminum extrusion and don't have a temperature contact, because of connection of sections with each other via heat non-conducting end plugs 3, 4. The fastening of the claimed LED luminaire to the lamp pole or other external bearing element is provided via crosstop 12, attached to the case 1, where LEDs are installed, and it improves heat removal from the case 1.

Damp protection of the claimed LED luminaire is provided by sealing the power source 5 and LED optical member, and connections of all other structure elements of the claimed LED luminaire may be non-hermetic.

To implement fast replacement of power source 5 of the claimed LED luminaire is provided by detaching the cover 2 together with power source 5 from end plugs 3, 4 at one side of the cover 2 after bolting out screws 17, connecting the cover 2 with the end plugs 3, 4, without dismantling other elements of the claimed LED luminaire.

To reach high degree of sealing of the claimed LED luminaire in case of temperature drops, LED optical members are connected with the case 1 by moldings 9. This kind of connection provides «floating » condition of optical members on the case 1 section (not thread connection). Optical members consist of aluminum circuit board 6, which is connected with the external surface 29 of the case 1 bottom wall and with lens plates 7, and the connection is sealed by high degree viscosity silicon, compensating the difference of aluminum coefficients of expansion, the case 1 made of, and lens plates 7. Alteration of lens plates 7 type results in alteration of the source of light type without any changes of other structure elements of the claimed LED luminaire.

Increase or decrease of the claimed LED luminaire capacity is performed by increase or decrease of case 1 and cover 2 sections length and, consequently, change of LEDs number and lenses in lens plates 7 in optical members and replacement of power source 5 for a higher capacity one without changing other structure elements of the claimed LED luminaire.

If it is necessary to decrease the temperature of LEDs heating in case of LEDs power increase in the claimed LED luminaire, having a possibility of increasing the area of cooling by attaching additional cooling elements to the case 1 section («blades »), inserted into T-shape long slots 28.

Besides this, illumination capacity symmetric increase is possible by connecting a number of LED between each other by H-shape longitudinal connector, performed with a possibility of insertion into T-shape long slots 28, and capacity of more than 500 W is easily achieved, and it corresponds to ~60000 lm of luminous flux.

The construction of the claimed LED luminaire has the following advantages:

minimum cost and labour content;

compliance with IP67 requirements according to operational climatic conditions;

providing possibilities of LEDs and power source operation in different and independent temperatures;

quick and easy procedure of power source replacement;

using in different conditions: road, street, industrial, at dangerous enterprises (with presence of gas, oil, petrol, chemicals etc.).

Hermetic zones are absent in the structure of the claimed LED luminaire, except for power source, optical members with LEDs and hermetic electrical wiring with wire-wire type hermetic connectors (wire-wire type connectors belong to IP67 or ⊓ P68 protection class), connecting them. So, the whole structure of the claimed LED luminaire is open for external air flows.

The case and cover are connected between each other, forming air clearance by end plugs, made of heat insulator. Connection of this kind provides heat isolation between the case and cover and provides ventilation between the sections in all directions of horizontal plane by penetration of cooling air flows through the air clearances between the case and cover. And the case and cover are simultaneously construction decorative elements and don't need a bonnet.

Despite of the fact that abovementioned variants of the claimed invention embodiment were presented to illustrate the claimed invention, it is clear for the specialists that different modifications, alterations and additions, not going out of the limits of the claimed invention, presented in the attached claim, are possible.

The invention claimed is:

1. An LED luminaire, comprising:

a case, a cover, a front end plug, a rear end plug, a power source, a fastening device, and an optical member with LEDs, which is connected with an external surface of a bottom part of the case via a thermal and hermetic contact, wherein the case and cover each comprise a heat conductive material and are connected with each other via the front and rear end plugs, wherein the front and rear end plugs each comprise a heat insulator and each define a through ventilation opening, wherein the power source is electrically and hermetically connected with the optical member with LEDs and connected to the cover from inside a hollow portion in the cover to form a thermal contact, wherein the fastening device is connected with the case and configured to fasten the LED luminaire to an external element, wherein the case defines a hollow section with a first open end and a second open end, wherein the cover comprises a section having a first open end part, a second open end part, and an open bottom that is directed towards a top part of the case, wherein a first cover wall, a second cover wall, the top part of the case form a through ventilation duct that is configured to allow in convection air flows to cool the cover, the power source and the top part of the case, wherein the ventilation openings of the first and second end plugs are connected with the hollow portion of the cover and are configured to allow convection air flows into the hollow portion, wherein the ventilation openings in the first and second end plugs are also connected with the hollow section of the case and are configured to allow convection air flows into the hollow section, wherein the cover is connected with the first and second end plugs at one side by a movable joint, and at another side by an articulated joint, wherein the cover is configured to open for replacement of the power source by actuating the movable joint, and wherein the LED luminaire further comprises a heat reflecting screen comprising a heat insulating material that is fixed on the first and second cover walls and that is configured to reflect heat produced from the case.

2. The LED luminaire according to claim 1, wherein the movable joint comprise a thread connection, which comprises a first threaded opening in the cover and a first captive screw that is bolted in the threaded opening in the cover and passes through the opening in the front end plug, wherein the articulated joint comprises a second threaded opening in the cover, a through opening in the front end plug and a second captive screw, acting as a shaft that is inserted in the through opening in the front end plug and bolted in the second threaded opening in the cover.

3. The LED luminaire according to claim 1, wherein the case is connected with the front and rear end plugs by four thread connections, each of which comprises its own threaded opening in an end part of the case, its own through opening in the front and rear end plugs and its own cutting screw, bolted in the respective threaded opening and passing through the respective through opening in the front and rear end plugs.

4. The LED luminaire according to claim 1, wherein the case has inner walls, which divide the hollow section of the case into multiple through ventilation ducts, having entrances and exits at the first and second end parts of the case and configured to allow convection air flows to cool the case.

5. The LED luminaire according to claim 4, wherein the case has two inner vertical walls, which divide the hollow section of the case into three through ventilation ducts.

6. The LED luminaire according to claim 1, wherein the case and the cover each comprise an aluminum structural extrusion.

7. The LED luminaire according to claim 1, wherein the cover section has a U-shaped cross-section, and the case comprises a trapezoidal cross-section.

8. The LED luminaire according to claim 1, wherein an external surface of the cover and an inner surface of the case each comprise a cooling fin.

9. The LED luminaire according to claim 1, wherein the optical member with LEDs comprises a circuit board, on one side of which LEDs are located, and a lens plate that covers the LEDs and hermetically connects with the circuit board, wherein the optical member with LEDs is connected with the external surface of the bottom part of the case by a connection, which comprises a knob located on the external surface of the bottom part of the case, and a hitch that is configured to be inserted in the knob, and wherein the hitch comprises a flexible elastic molding.

10. The LED luminaire according to claim 9, wherein the lens plate is hermetically connected with the circuit board by silicon sealing agent.

11. The LED luminaire according to claim 9, wherein the optical member with LEDs has a rectangular shape, and is pressed by multiple hitches to the external surface of the bottom part of the case along at least two sides.

12. The LED luminaire according to claim 9, wherein the fastening device comprises a crosstop and a field tube, wherein a front end of the crosstop is connected with the case, wherein a rear end of the crosstop is connected with the field tube, wherein the field tube is configured to connect with an external bearing element, and wherein a connection between the crosstop and the field tube is covered by a protective corrugated tube.

13. The LED luminaire according to claim 12, wherein a front end of the crosstop is inserted into an opening of the rear end plug and into a central ventilation duct of the case, and wherein a rear end of the crosstop is inserted into the field tube.

14. The LED luminaire according to claim 12, wherein the external element, comprises at least one of a lamp pole hearing element, a ceiling, and a wall.

15. The LED luminaire according to claim 1, wherein the case comprises two side walls each having a T shaped elongated slot, and further comprising an H-shape longitudinal connector that is configured such that a portion of the H-shaped longitudinal connector is sized and shaped to fit inside of the external T-shape elongated slot.

16. The LED luminaire according to claim 15, further comprising a neighbor LED luminaire, that also has a second external T-shape elongated slot in its side walls.

17. The LED luminaire according to claim 15, further comprising at least two additional cooling elements that each define a T-shaped cusp, located in the T-shape elongated slots of the first and second sides of the case.

18. The LED luminaire according to claim 15, further comprising a decorative side molding, located in the external T-shape elongated slot of the first case side wall.

19. The LED luminaire according to claim 1, further comprising a decorative upper molding, fixed longitudinally on an external surface of cover top walls and covering a place of connection of the power source with the cover.

20. The LED luminaire according to claim 1, wherein the power source is electrically and hermetically connected with the optical member with LEDs by an electrical hermetic connection that includes hermetic electrical wiring and a wire-wire type hermetic electrical connector.

* * * * *